US005105502A

United States Patent [19]

Takashima

[11] Patent Number: 5,105,502

[45] Date of Patent: Apr. 21, 1992

[54] VACUUM CLEANER WITH FUNCTION TO ADJUST SENSITIVITY OF DUST SENSOR

[75] Inventor: Yoshinori Takashima, Oomihachiman, Japan

[73] Assignee: Matsushita Electric Industrial Co., Ltd., Osaka, Japan

[21] Appl. No.: 713,614

[22] Filed: Jun. 11, 1991

Related U.S. Application Data

[63] Continuation of Ser. No. 444,265, Dec. 1, 1989, abandoned.

[30] Foreign Application Priority Data

Dec. 6, 1988 [JP] Japan ..... 63-308012

[51] Int. Cl.[5] ..... A47L 9/28

[52] U.S. Cl. ..... 15/319; 15/339; 15/377; 250/574; 356/438

[58] Field of Search ..... 356/338, 342, 343, 438, 356/439

[56] References Cited

U.S. PATENT DOCUMENTS

| | | | |
|---|---|---|---|
| 3,579,706 | 5/1971 | Hetland | 15/377 |
| 3,588,943 | 6/1971 | Hetland | 15/377 |
| 4,342,132 | 8/1982 | Fromknecht | 15/339 |
| 4,580,311 | 4/1986 | Kurz | 356/438 X |
| 4,601,082 | 7/1986 | Kurz | 15/319 |
| 4,611,365 | 9/1986 | Komatsu et al. | 15/339 |
| 4,654,924 | 4/1987 | Getz et al. | 15/319 |
| 4,680,827 | 7/1987 | Hummel | 15/319 |
| 4,706,327 | 11/1987 | Getz et al. | 15/354 X |
| 4,767,213 | 8/1988 | Hummel | 250/574 X |
| 4,920,605 | 5/1990 | Takashima | 15/319 |
| 4,942,640 | 7/1990 | Hayashi et al. | 15/319 |
| 4,953,253 | 9/1990 | Fukuda et al. | 15/319 |
| 4,977,639 | 12/1990 | Takahashi et al. | 15/319 |

FOREIGN PATENT DOCUMENTS

| | | | |
|---|---|---|---|
| 0312111 | 4/1989 | European Pat. Off. | 15/319 |
| 52-123147 | 10/1977 | Japan . | |
| 2063659 | 6/1981 | United Kingdom . | |

*Primary Examiner*—Philip R. Coe
*Assistant Examiner*—C. Cooley
*Attorney, Agent, or Firm*—Pollock, VandeSande & Priddy

[57] ABSTRACT

A vacuum cleaner includes an agitator brush which only becomes operational when a carpeted floor is being cleaned. In order to avoid erroneous activation of a dust indicator lamp when individual strands of carpet pile are pulled onto the cleaner, a surface discrimination device lowers the sensitivity of a dust sensor circuit, which drives the lamp, when shag or high pile carpet is encountered so as to prevent erroneous signaling of the presence of dust.

5 Claims, 1 Drawing Sheet

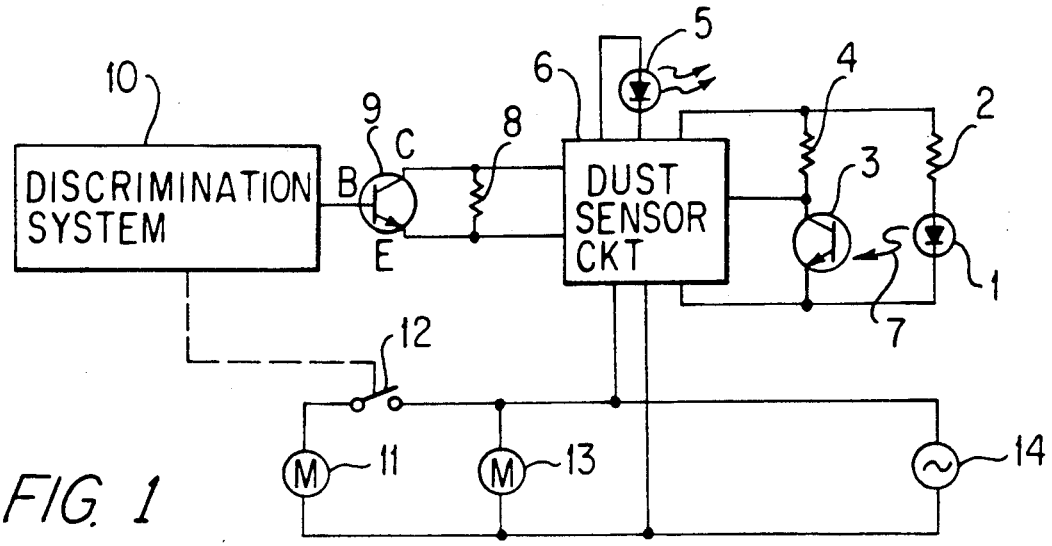
FIG. 1
FIG. 2
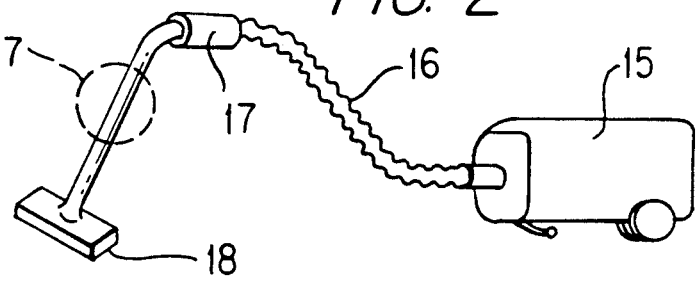
FIG. 3
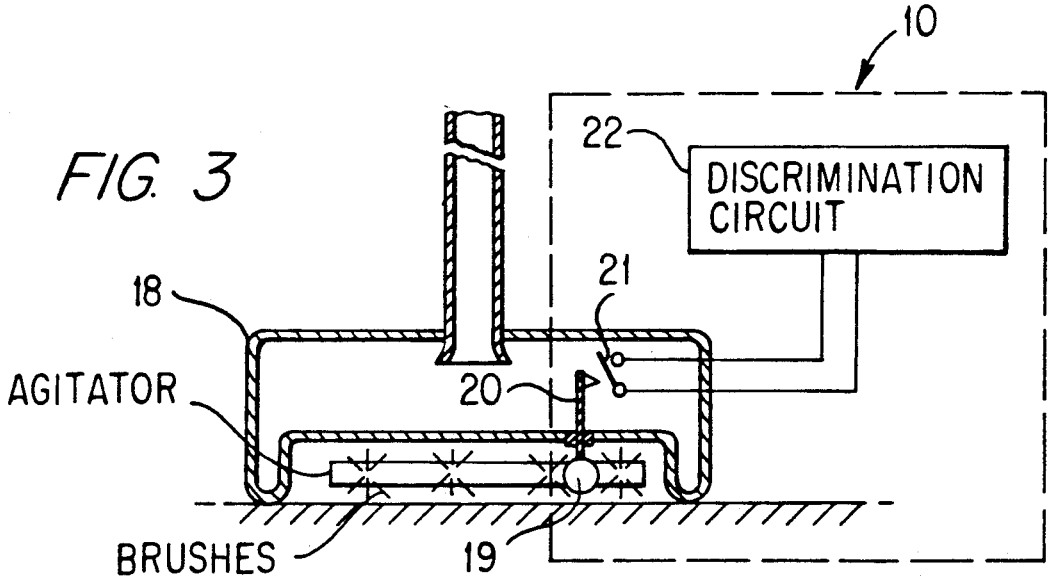

VACUUM CLEANER WITH FUNCTION TO ADJUST SENSITIVITY OF DUST SENSOR

This application is a continuation of Ser. No. 07/444,265 filed on Dec. 1, 1989, now abandoned.

BACKGROUND OF THE INVENTION

The present invention relates generally to vacuum cleaners, and more particularly to a sensitivity adjusting apparatus of a dust sensor for use in such a vacuum cleaner.

Known is a vacuum cleaner with a dust sensor provided in an air passage between a suction opening and a dust collecting device. When dust is included in the drawn air, the dust sensor senses the dust to indicate the presence of the dust by means of an indication lamp, for example, and to heighten the rotational speed of an electric blower for a predetermined time period. However, for adequate cleaning, the adjustment of the sensitivity of the dust sensor is required in accordance with the kind of an object to be cleaned by the vacuum cleaner. For example, when cleaning a shaggy carpet, the dust detection sensitivity is required to be lowered as compared with the sensitivity for a bare floor such as a board floor, because the dust sensor tends to detect pile of the shaggy carpet as dust. Preferably, the adjustment of the sensitivity of the dust sensor is automatically effected in accordance with the kind of floor to be cleaned by a vacuum cleaner.

SUMMARY OF THE INVENTION

The primary goal of the invention is to prevent the presence of loose pile, pulled into the vacuum cleaner, from being detected as dust which would cause erroneous lighting of the dust indication lamp.

It is therefore an object of the present invention to provide a vacuum cleaner with a dust sensor which is automatically adjustable in sensitivity in accordance with the kind of floor to be cleaned by the vacuum cleaner.

In accordance with the present invention, there is provided a vacuum cleaner comprising: dust sensor means for detecting dust in air drawn through a suction passage of the vacuum cleaner to generate a dust signal indicative of the result of the detection; adjusting means for adjusting the sensitivity of the dust sensor means for the dust detection in accordance with a control signal; and discrimination means for detecting the kind of floor to be cleaned by said vacuum cleaner to generate a discrimination signal indicative of the kind of floor to be cleaned. The discrimination signal is supplied as the control signal to the adjusting means to adjust the sensitivity of said dust sensor means.

Preferably, the adjusting means comprises a resistor and a transistor which are connected in parallel relation to each other, the transistor being arranged to short the resistor in response to the discrimination signal from the discrimination means. The discrimination means includes switching means which is arranged to be opened or closed in accordance with a state of a surface of the object and which generates the discrimination signal when the switching means enters into the opened or closed state. Further, the discrimination means includes roller means which rolls along the surface of the object and which is movable up and down in accordance with the state of the surface of the object, the up-and-down movements of the roller means causing the opening and closing operation of the switching means.

BRIEF DESCRIPTION OF THE DRAWINGS

The present invention will be described in further detail with reference to the accompanying drawings, in which:

FIG. 1 is a circuit diagram showing a circuit arrangement for use in a vacuum cleaner according to an embodiment of the present invention;

FIG. 2 is a perspective view of a vacuum cleaner having a dust sensor in a suction passage; and FIG. 3 is an illustration for describing one example of a discrimination system to be used in the embodiment of this invention.

DETAILED DESCRIPTION OF THE INVENTION

Referring now to FIG. 1, there is schematically illustrated a circuit arrangement to be used in a vacuum cleaner according to an embodiment of the present invention. In FIG. 1, the circuit arrangement includes a dust sensor 7 comprising an infrared light-emitting diode (LED) 1 which emits infrared light and a phototransistor 3 which produces a current corresponding to the light emerging from the infrared LED 1. The dust sensor 7, as illustrated in FIG. 2, is provided in a suction passage between a suction nozzle 18 and an operating section 17 which is in turn coupled through a hose 16 to a body 15 of the vacuum cleaner. The output of the phototransistor 3 is led into a dust sensor circuit 6. Numeral 2 represents a resistor for determining the current to be introduced into the infrared LED 1 and numeral 4 designates a load resistor for the phototransistor 3. A fan motor 13 operates at constant speed regardless of the type of floor being cleaned, or the quantity of dust encountered. In response to rotation of a fan motor 13 coupled to a power source 14, air is drawn from the suction nozzle 18 into the suction passage, and when dust is included in the drawn air, the infrared light from the infrared LED 1 is interrupted, and the dust sensor circuit 6 turns on an indication lamp 5, for example, in accordance with a signal from the dust sensor 7. The primary goal of the invention is to prevent the presence of loose pile, pulled into the vacuum cleaner, from being detected as dust which would cause erroneous lighting of the dust indication lamp. The dust sensor circuit 6 is coupled to a resistor 8, the sensitivity of detection of the drawn dust being variable in accordance with the magnitude of the resistance of the resistor 8. Although an illustration of a detailed arrangement is omitted, the dust sensor circuit 6 includes, for example, an operational amplifier coupled to the resistor 8, the amplification degree thereof depending upon the resistance value of the resistor 8. The dust detection sensitivity becomes higher in accordance with an increase in the amplification degree of the operational amplifier so as to be adjustable by means of the control of the resistance value of the resistor 8. Numeral 11 depicts an electric motor for an agitator such as a rotatable brush of the vacuum cleaner which is driven by operation of a switch 12. As explained hereinafter, the agitator operates when carpet is cleaned but does not rotate when a bare floor is cleaned.

Also included is a discrimination system 10 which is coupled to the dust sensor circuit 6 in parallel relation to the resistor 8. The discrimination system 10 includes a discrimination circuit 22 in addition to roller 19 which is provided in the suction nozzle 18 as illustrated in FIG. 3 so as to be movable along the surface of an object to be cleaned. Further, the roller 19 has a rod 20 which is slidably supported by a wall of the suction nozzle 18 so as to be movable up and down in response to vertical movements of the roller 19 due to irregularity of the surface of a floor. The rod 20 is engageable with a switch 21 so that switch 21 is opened and closed in accordance with the up-and-down movements of the rod 20. The switch 21 is coupled to discrimination circuit 22 which is arranged to generate a discrimination signal in response to the closed state of the switch 21. That is, when cleaning a board floor, the roller 19 is horizontally moved along the surface of the board floor and the rod 20 is kept at the lowered position whereby the switch 21 takes the opened state. On the other hand, when cleaning a carpet, the roller 19 is pressed upwardly by the rising of a portion of the carpet with respect to portions of the suction nozzle which are in contact relation to the carpet during the cleaning, whereby the rod 20 depresses the switch 21 so that the switch 21 enters into the closed state. The discrimination circuit 22 produces the discrimination signal in response to the closing of the switch 21, which occurs when carpet is being cleaned, not a bare floor. Here, it is also appropriate to use a different system such as an optical system and an ultrasonic system which is capable of detecting the rising of the object to be cleaned by means of detecting reflection of light or an ultrasonic wave emitted by an adequate device.

Turning back to FIG. 1, when cleaning a carpet, the discrimination signal is generated and supplied to the base (B) of a transistor 9, the collector (C) and emitter (E) being coupled to both ends of the resistor 8 and further to terminals of the dust sensor circuit 6. In response to the generation of the discrimination signal, the transistor 9 allows the short between the collector and emitter so as to short both the ends of the resistor 8, thereby resulting in lowering the detection sensitivity of the dust sensor circuit 6. Therefore, vacuumed loose pile being drawn into the vacuum cleaner will not be mistaken for dust, and the dust indicator light 5 will not be activated. In addition, the discrimination circuit 10 is coupled to the motor-driving switch 12 so that, when cleaning the carpet, the motor-driving switch 12 is automatically closed in response to the discrimination signal generated from the discrimination circuit 10 so as to drive the electric motor 11 to operate an agitator encased in the suction nozzle 18. Switch 12 remains open when cleaning a bare floor so that the agitator does not operate. Thus, the motor-driving switch 12 may be of the electromagnetic type.

It should be understood that the foregoing relates to only a preferred embodiment of the present invention, and that it is intended to cover all changes and modifications of the embodiment of the invention herein used for the purposes of the disclosure, which do not constitute departures from the spirit and scope of the invention.

What is claimed is:

1. A vacuum cleaner with a suction nozzle which draws dust from an object to be cleaned and which has therein a rotatable member coming into contact with said object, said vacuum cleaner comprising:

dust sensor means for detecting a quantity of dust present in air drawn through a suction passage of said vacuum cleaner coupled to said suction nozzle to generate a dust signal indicative of the result of the detection; adjusting means for adjusting the sensitivity of said dust sensor means for the dust detection in accordance with a control signal; and discrimination means for detecting the kind of object to be cleaned by said vacuum cleaner to generate a discrimination signal indicative thereof, said discrimination signal being supplied as the control signal to said adjusting means to adjust the sensitivity of said dust sensor means and further supplied to switching means which is in turn operable so as to drive said rotatable member in said suction nozzle.

2. A vacuum cleaner as claimed in claim 1, wherein said adjusting means comprises a resistor and a transistor which are connected in parallel relation to each other, said transistor being arranged to short said resistor in response to the discrimination signal from said discrimination means.

3. A vacuum cleaner as claimed in claim 1, wherein said discrimination means includes discrimination switching means which is provided in said suction nozzle of said vacuum cleaner and which is arranged to be opened or closed in accordance with a state of a surface of said object and which generates said discrimination signal when said discrimination switching means is switched to a preselected position.

4. A vacuum cleaner as claimed in claim 3, wherein said discrimination means includes roller means which rolls along the surface of said object and which is movable up and down in accordance with the state of the surface of said object, the up-and-down movements of said roller means causing the opening and closing operation of said discrimination switching means.

5. A vacuum cleaner as claimed in claim 1, wherein said discrimination means is coupled to motor-driving switching means for driving an electric motor for operating an agitator provided in said suction nozzle of said vacuum cleaner, so that said electric motor is operable in response to said discrimination signal from said discrimination means.

* * * * *